United States Patent [19]

Wolowski et al.

[11] Patent Number: 4,636,300

[45] Date of Patent: Jan. 13, 1987

[54] INTEGRATED GAS-PHASE HYDROGENATION PROCESS USING HEAT RECOVERED FROM SUMP-PHASE HYDROGENATION FOR TEMPERATURE REGULATION

[75] Inventors: Eckard Wolowski, Mülheim; Frank Mirtsch, Bottrop, both of Fed. Rep. of Germany

[73] Assignee: Ruhrkohle Aktiengesellschaft, Essen, Fed. Rep. of Germany

[21] Appl. No.: 775,920

[22] Filed: Sep. 13, 1985

[30] Foreign Application Priority Data

Sep. 13, 1984 [DE] Fed. Rep. of Germany ..... 34336257

[51] Int. Cl.[4] ..... C10G 1/00; C10G 1/06

[52] U.S. Cl. ..... 208/400; 208/407; 208/419

[58] Field of Search ..... 208/8 LE, 10

[56] References Cited

U.S. PATENT DOCUMENTS

| | | | |
|---|---|---|---|
| 3,823,084 | 7/1974 | Schroeder | 208/10 |
| 3,862,108 | 1/1975 | Layng | 208/108 |
| 3,884,649 | 5/1975 | Mathews | 48/202 |
| 3,926,775 | 12/1975 | Schroeder | 208/10 |
| 3,950,244 | 4/1976 | Chun et al. | 208/143 |
| 3,953,180 | 4/1976 | Hoffert et al. | 48/215 |
| 4,036,731 | 7/1977 | Martin | 208/8 |
| 4,057,402 | 11/1977 | Patel et al. | 48/197 R |
| 4,099,933 | 7/1978 | Johnson et al. | 48/202 |
| 4,123,502 | 10/1978 | Hölter et al. | 423/230 |
| 4,152,244 | 5/1979 | Raichle et al. | 208/10 X |
| 4,189,374 | 2/1980 | Kirby et al. | 208/10 X |
| 4,189,375 | 2/1980 | Kirby et al. | 208/10 X |
| 4,191,539 | 3/1980 | Patel et al. | 48/210 |
| 4,214,974 | 7/1980 | Würfel | 208/10 |
| 4,221,654 | 9/1980 | Stein et al. | 208/15 |
| 4,222,844 | 9/1980 | Nizamoff | 208/10 |
| 4,331,530 | 5/1982 | Qader | 208/10 |
| 4,350,582 | 9/1982 | Rosenthal et al. | 208/10 X |
| 4,387,015 | 6/1983 | Thorogood et al. | 208/10 X |
| 4,400,263 | 8/1983 | Kydd et al. | 208/10 |
| 4,406,744 | 9/1983 | Berg | 201/17 |
| 4,410,646 | 10/1983 | Romey et al. | 524/65 |
| 4,411,765 | 10/1983 | Matsuura et al. | 208/8 LE |
| 4,421,632 | 12/1983 | Würfel | 208/10 |
| 4,444,698 | 4/1984 | Lang et al. | 261/157 |
| 4,468,315 | 8/1984 | Romberg | 208/10 |
| 4,473,460 | 9/1984 | Küerten et al. | 208/10 |
| 4,485,003 | 11/1984 | Coenen et al. | 208/10 |
| 4,487,684 | 12/1984 | Würfel | 208/10 |
| 4,492,623 | 1/1985 | Würfel | 208/10 |
| 4,512,873 | 4/1985 | Escher et al. | 208/10 X |

FOREIGN PATENT DOCUMENTS

| | | | |
|---|---|---|---|
| 2651253 | 5/1978 | Fed. Rep. of Germany | 208/10 |
| 2810479 | 9/1978 | Fed. Rep. of Germany | 208/10 |
| 2945352 | 5/1981 | Fed. Rep. of Germany | 208/10 |

*Primary Examiner*—Andrew H. Metz
*Assistant Examiner*—William G. Wright
*Attorney, Agent, or Firm*—Nils H. Ljungman

[57] ABSTRACT

Process for sump-phase hydrogenation with integrated gas-phase hydrogenation relevant parameters being adjusted so that an economical heat recovery for the entire system is achieved, despite increasing incrustation of the mash heat exchanger and the increasing deactivation of the gas-phase catalyst. The process-relevant temperatures of the intermediate precipitator and of the gas-phase reactor are precisely adjusted by the use of head coolers which follow the sump-phase hydrogenator, and by head coolers which precede the intermediate precipitator. The procedure is such that the waste heat from the sump-phase products is partially recovered by using it to heat the raw materials constituting the gas phase and by feeding it back again to the mash heater.

16 Claims, 2 Drawing Figures

INTEGRATED GAS-PHASE HYDROGENATION PROCESS USING HEAT RECOVERED FROM SUMP-PHASE HYDROGENATION FOR TEMPERATURE REGULATION

BACKGROUND OF THE INVENTION

1. Field of the Invention:

The invention relates to the regulation of a combined sump-phase/gas-phase hydrogenation process. It also relates to the recovery of the utilizable heat which is obtained as a result of cooling and condensing the product streams from the sump-phase and gas-phase hydrogenation. The heat is appropriately used for heating both the raw materials of the respective sump-phase and gas-phase reactors. Typically, the materials to be hydrogenated comprise coals, heavy oils and/or tars.

In a heat recovery of the above-mentioned type, the process parameters relevant to the sump-phase hydrogenation operation effected with the integrated gas-phase reactor must be taken into account.

2. Description of the Prior Art:

In accordance with the earlier proposal, in order to increase the efficiency of a hydrogenation plant, the sump-phase hydrogenator and the gas-phase hydrogenator are arranged in a common high pressure circuit.

In the process, the major part of the solvent is appropriately drawn off in the sump of an intermediate precipitator which follows after the sump-phase hydrogenator (those with the low and medium boiling points) are caused to travel via the succeeding gas-phase reactor. This desired quantitative splitting of the sump-phase products into a solvent fraction which is liquid, on the one hand and the raw material in vapor-form for the gas-phase hydrogenation, on the other hand, is effected by employing a definite temperature setting in the intermediate precipitator which follows after the sump-phase hydrogenator.

However, this temperature setting is difficult to maintain, due to the fact that the mash-heat exchanger, which is employed to heat the mash by indirect heat exchange using cooling sump-phase gas/vapor, incrustates with increasing operating time. Because of the variable heat transfer efficiency of the mash heat exchanger, additional cooling is required in order to reach the required temperature and thus attain the desired quantitative division in the intermediate precipitator. It is also known that the incrustation of the mash preheater increases with increasing mash temperature. Consequently, an upper limit must be set to the mash exit temperature of the mash heat exchanger.

Furthermore, for the sump-phase hydrogenation with the integrated gas-phase reactor, allowance must be made for the fact that, as the gas-phase catalyst becomes progressively deactivated, the temperature of the gas-phase raw materials must be raised, for example, from 390° to 430° C. In addition, it is essential that, as far as possible, the plant can be started up swiftly and smoothly without additional heating-up capacities.

Some examples of refining are provided in the following U.S. Pat. Nos. 4,485,003; 4,473,460; 4,444,698; 4,410,646; 4,406,744; 4,331,530; 4,221,654; 4,191,539; 4,123,502; 4,099,933; 4,057,402; 4,036,731; 3,953,180; 3,950,244; 3,926,775; 3,884,649; and 3,862,108. All of the aforementioned patents are incorporated herein by reference.

OBJECTS OF THE INVENTION

An object of the invention is to ensure an adjustment to the required temperatures for the mash, the intermediate precipitator and the gas-phase raw materials, despite the variable heat efficiency of the mash heat exchanger.

A further object of the invention is to achieve an economical heat recovery from the hydrogenation products.

An yet further object of the invention is to provide a process in which the starting-up of the plant should not require any additional heating furnace for the gas-phase hydrogenation.

SUMMARY OF THE INVENTION

These objects are accomplished in accordance with the invention in that, despite the variations in the heat transfer efficiency of the mash heat exchanger due to progressive incrustation, and variable gas-phase reactor parameters due to progressive catalyst deactivation, the required process temperatures for the intermediate precipitator and the gas-phase reactor are adjusted with the aid of a head cooler which follows the sump-phase hydrogenator, and a head cooler located ahead of the intermediate precipitator. The head cooler following the sump-phase hydrogenator serves simultaneously to initiate the gas-phase hydrogenating process and to limit the maximum mash exiting temperature of the mash heat exchanger, if need be, by means of a bypass.

With increasing operating time, the temperature of the gas-phase raw material must be gradually raised. In accordance with the invention, this is effected without additional heating furnaces by arranging so that, as the incrustation of the mash heat exchanger progressively increases, the temperature level of the head cooler ahead of the intermediate precipitator is also increased. At the same time, as a result of this, with the progressive reduction in the heat transferring efficiency of the mash heat exchanger, the waste heat resulting from the sump-phase hydrogenation is transferred via the gas-phase hydrogenator to the series-connected mash preheater of the sump-phase hydrogenator, and is thus utilized economically.

The setting of the required temperature in the intermediate precipitator is effected by a secondary cooler in which steam is appropriately produced or hydrogenation gas is preheated.

By means of the head cooler which follows the sump-phase hydrogenator, it is additionally possible to reduce the temperature level of the sump-phase gases/vapors entering the mash heat exchanger. By this means, the otherwise usually rapid incrustation of clean tubes of the mash heat exchanger is reduced because the maximum occurring mash temperature, with the same mean mash exiting temperature, is lowered.

The desired temperature of the raw material for the gas-phase hydrogenator can be set by means of the head cooler, including the bypass, which follows the sump-phase hydrogenator.

The bypass around the mash-heat exchanger serves to limit the mash exit temperature of the mash heat exchanger, especially when the heat exchanger tubes are clean.

With the above-described procedure, it is thus possible to set or adjust all temperatures relevant to the process even in the case of time-independent incrustation of the mash heat exchanger, as well as the deactivation of the gas-phase catalyst.

The start-up process is effected smoothly and rapidly by heating the raw materials constituting the gas phase by means of the head cooler, which follows the sump-phase hydrogenator.

DESCRIPTION OF THE PREFERRED EMBODIMENTS

The process will not be described in greater detail on the basis of the following examples of operation.

Figure 1:
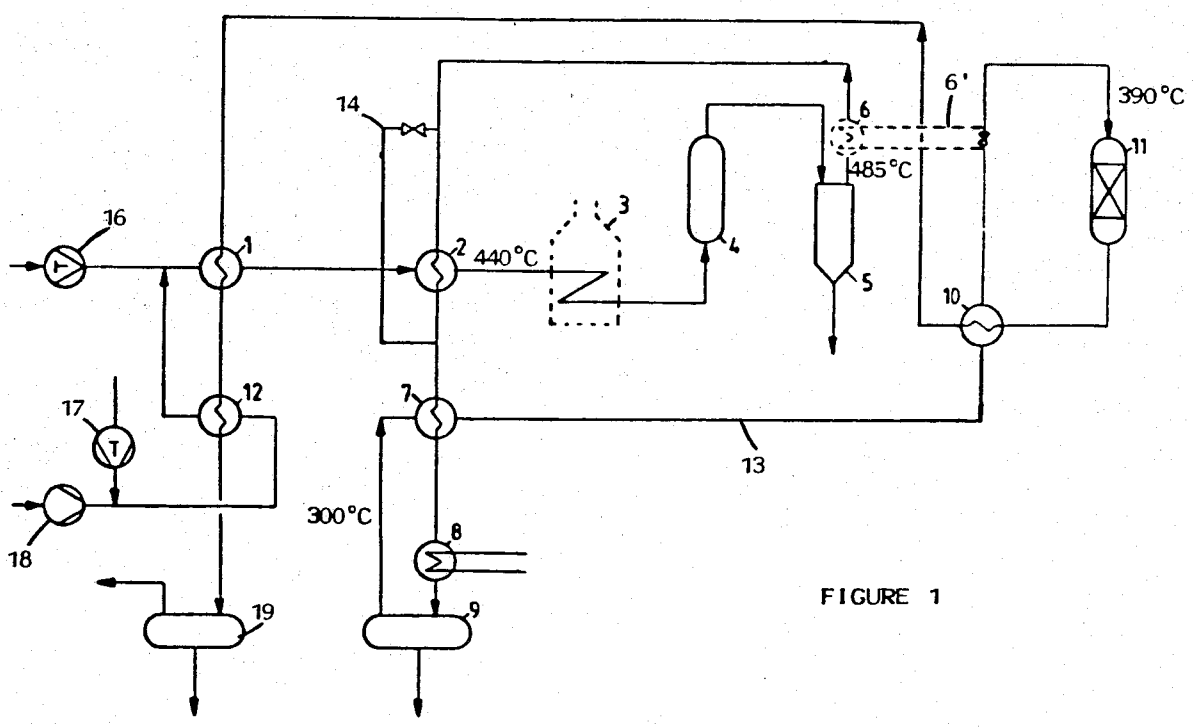
FIG. 1 shows a schematic process diagram of the plant according to the invention, which has been operated a relatively short time from start-up.

Based on FIG. 1, an operating state of the invention is described in which the plant has been in operation for a short time, with only a slight incrustation in the mash heat exchangers 1 and 2, and where the catalyst in a gas-phase reactor 11 is still fresh.

The gaseous and vapor-form products from a sump-phase reactor 4 are partially cooled by indirect heat exchange by means of the mash heat exchanger 2, whereby, on the heating-up side, the mash-hydrogenation gas mixture is heated to the starting-up temperature of the hydrogenating sump-phase reactor 4, which is about 440° C. In order to set the temperature, specified for the process in the intermediate precipitator 9 at about 300° C., the sump-phase products are further cooled by direct heat exchange in a head cooler 7 and in a secondary cooler 8. The products from the hydrogenating sump-phase reactor 4 are subdivided in an intermediate precipitator 9 into the solvent fraction (liquid) and into the feed-stream for the gas-phase hydrogenation process (gases/vapors). The gas-phase hydrogenation gases/vapors are heated first in the head cooler 7 and then in an indirect heat exchanger 10 to a gas-phase reaction temperature of about 390° C.

The gas-phase products are partially cooled by indirect heat exchange in the mash heat exchanger 1, thereby causing the mash-hydrogenation gas mixture to be preheated.

In an indirect heat exchanger 12, the hydrogenation gas is preheated by further cooling the gas-phase products.

In the stationary operating case, the entire process is thermally self-sufficient. A mash heating furnace 3 serves solely as a start-up furnace.

Waste heat from a secondary cooler 8, which exchanges heat from the hydrogen gas originating from a hot precipitator 5, is advantageously employed for producing medium pressure steam or to preheat the hydrogenation gas.

Prior to entering the mash heat exchanger 2, used for preheating, the gaseous and vapor-form products from the hot precipitator 5 can be cooled somewhat by means of a second head cooler 6. A bypass 6' from the second head cooler 6 is connected to a line from the intermediate precipitator 9, which goes through the head cooler 7 and the heat exchanger 10 before being in communication with the bypass 6' prior to the entry of the line into the gas-phase reactor 11. A bypass 14 is provided around the heat exchanger 2 for bypassing at least a portion of the gaseous and vapor-form products from the hot precipitator 5 to regulate the temperature in the heat exchanger 2. A bypass 15 is also provided about the heat exchanger 10 in a conduit 13. Typically, the raw materials are mashed together in mashers 16 and 17, and then fed to the mash heat exchanger 1. The output of the masher 17 is also fed through the indirect heat exchanger 12. Other raw materials, such as oils, are preferably fed into the system through input unit 18. By this means, incrustation is reduced in the mash heat exchanger 1.

EXAMPLE 1

Example 1 covers operation during a short transit time, when there is only a slight incrustation in the mash heat exchangers 1 and 2, and fresh catalyst in the gas-phase reactor 11.

The mash has a temperature of from 170° C. and a pressure of about 320 bars. The mash moving through the system comprises, for each 100 kilograms of coal (WAF), 70 kilograms of oil, 80 kilograms heavy oil, 6 kilograms catalyst (Bavarian vein with approximately 30% $Fe_2O_3$). The 100 kilograms of coal are a standard normalized input sample quantity. This mixture is mixed with 55 kilograms of gas for hydration. The total mixture is preheated in the indirect heat exchanger 12 from 80° C. to 200° C. The mixture is then heated to 340° C. in the mash heat exchanger 1 and subsequently to 430° C. in the mash heat exchanger 2. In steady state operation, the mash heating furnace 3 is taken out of operation in the process. In the sump-phase reactor 4, there is introduced to the product therein approximately 40 kilograms of gas of hydration, as a quenching gas. After the flow through the sump-phase reactor 4, the product is divided into a sump product and a head product. The temperature in the hot precipitator 5 is about 475° C. and the pressure 300 bar. In 66 kilograms of sump product, there are 7 kilograms of medium oil, 41 kilograms of heavy oil, 1 kilogram of gases and 17 kilograms of solids. The 291 kilograms of head product is broken up into 176 kilograms of oil vapors and 115 kilograms of gases from the hydration which are led to the mash heat exchanger 2. From this gas to the mash heat exchanger 2, about up to 20% is bypassed therearound, and the gas is cooled to 400° C. When the temperature in the process reaches the predetermined temperature of approximately 300° C. in the intermediate precipitator 9, the product is indirectly heat exchanged in the head cooler 7 and in the secondary cooler 8, where it is cooled further. In the intermediate precipitator 9, the product is divided into 126 kilograms solvent in fluid form. In this solvent, 1 kilogram gas is dissolved and 164 kilograms of head product which comprises 114 kilograms gas, 18 kilograms light oil vapors, 30 kilograms medium oil vapors, and 2 kilograms heavy oil vapors. The sump product is recirculated with the solvent material portion. The head product is used as a feed stream for the gas-phase hydration in the head cooler 7, which operates at a temperature of 365°, and finally the head product is conducted to the indirect heat exchanger 10 where the gas-phase reaction temperature is from about 390° C. The gas-phase reactor 11 has 18 kilograms of cold gas provided to it. The gas-phase product, through the action of indirect heat transfer in the indirect heat exchanger 10, is cooled from 410° C. to 390° C. Then the gas-phase product is transported to the mash heat exchanger 1 and cooled to a temperature of 220° C., and finally to the indirect heat exchanger 12 and there cooled to a temperature of 185° C. The gas-phase product is then transported to another unit 19, such as a precipitator, for further processing. The outputs from the intermediate precipitator 9 and the unit 19 are transported to other parts of the installation for other uses.

Figure 2:
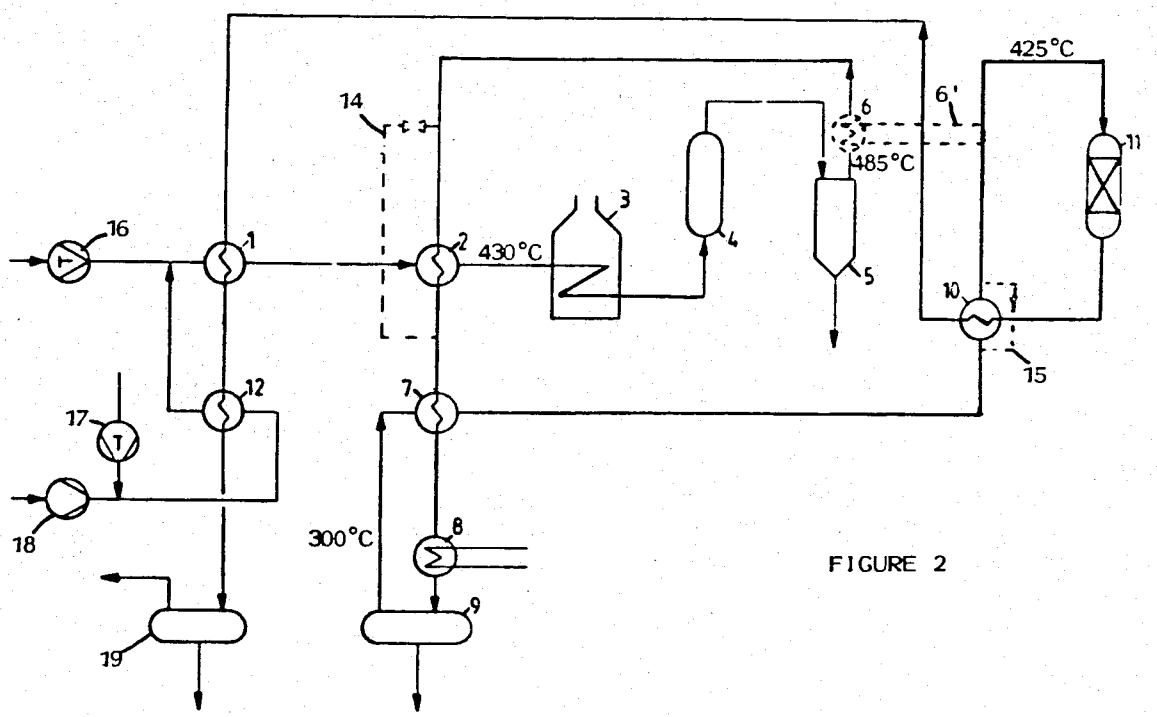
FIG. 2 shows a schematic process diagram of the plant according to the invention, which has been operated a relatively long time from start-up.

Based on FIG. 2, a description is given of the operating state of the invention after operating for a longer period, with heavy incrustation in the mash heat exchangers 1 and 2 and with a deactivating catalyst in the gas-phase reactor 11.

As a result of the reduced heat transfer efficiency of the mash heat exchanger 2, the feed temperature behind the head cooler 7 is raised by about 20° C., as compared with Example 1. The gas-phase inlet temperature rises to about 425° C.

EXAMPLE 2

This example deals with operation with short transit time and with heavy incrustation in the mash heat exchangers 1 and 2 and with a deactivating catalyst in the gas phase reactor 11.

The mash enters the system at a temperature of 170° C. and at a pressure of about 320 bars. The mash is comprised of a standard mass of 100 kilograms of coal (WAF), to which are added 70 kilograms of medium oil, 80 kilograms of heavy oil, 6 kilograms of catalyst (Bavarian vein with approximately 30% $Fe_2O_3$). This mixture is further mixed with 55 kilograms of gas for hydration. The gas for hydration is preheated in the indirect heat exchanger 12 from an initial temperature of 80° C. to 200° C., then mixed with the mash and heated in the mash heat exchanger 1 to a temperature of 355° C., and finally heated in the mash heat exchanger 2 to a temperature of about 415° C. In the chemical reaction, approximately 40 kilograms of gas of hydration, as a quenching gas, is introduced into the product. After flowing through the chemical or sump-phase reactor 4, the product is divided in the hot precipitator 5 into a sump product and into a head product. The product is precipitated in the Hot Precipitator 5 at a pressure of about 300 bars and cooled in the mash heat exchanger 2 when the bypass ratio is 0% to a temperature of 420° C. The process temperature in the intermediate precipitator 9 is adjusted to a temperature of approximately 300° C. and the product is then further cooled indirectly through heat exchange in the head cooler 7 and the secondary cooler 8. In the intermediate precipitator 9, the product is dissolved in a solvent which is fluid. To the standard sample of the product, 126 kilograms of solvent is added, in which 1 kilogram of gas is dissolved. A head product is also produced which, for the standard input quantity, comprises 164 kilograms head product. This head product is comprised of 114 kilograms of gas, 18 kilograms of light oil vapors, 30 kilograms of medium oil vapors, and 2 kilograms of heavy oil vapors. The sump product is recirculated as a solvent material. The head product is used as a feed stock for the gas-phase hydration and is heated in the head cooler 7 to 380° C. and finally heated in the indirect heat exchanger 10 and the head cooler 6 to the gas-phase reaction temperature of 420° C. The gas-phase product is indirectly heat exchanged by cooling in the indirect heat exchanger 10 from a temperature of 440° C. to a temperature of 415° C., then cooled in the mash heat exchanger 1 to a temperature of 250° C., and finally cooled to a temperature of 215° C. in the indirect heat exchanger 12.

The invention as described hereinabove in the context of the preferred embodiments is not to be taken as limited to all of the provided details thereof, since modifications and variations thereof may be made without departing from the spirit and scope of the invention.

What is claimed is:

1. In a sump-phase hydrogenation process having gas-phase hydrogenation, a method of regulating the temperature of carbonaceous input material being inputted to said hydrogenation process, said method of regulating comprising:

extracting heat from a head output product from a sump-phase hydrogenator;

heating said carbonaceous input material being inputted to said hydrogenation process through indirect heat exchange with at least a portion of said heat extracted from said sump-phase hydrogenator;

adjusting heat transfer from said heat extracted from said sump-phase hydrogenator to produce temperatures in a predetermined range by selectively bypassing any further remaining portion of said heat extracted from said sump-phase hydrogenator, wherein the further portion so by-passed is selected to compensate for a reduction in heat transfer efficiency in the heating of said carbonaceous input material;

extracting additional heat from an output of a gas-phase reactor; and heating said carbonaceous input material with said additional heat extracted from said output of said gas-phase reactor whereby heat generated in different portions of said sump-phase hydrogenation process is used to heat said carbonaceous input material substantially to a start up temperature of reaction.

2. In a sump-phase hydrogenation process having gas-phase hydrogenation, the method of regulating the temperature of carbonaceous input material according to claim 1 wherein said extracting of heat from said sump-phase hydrogenation is done between said sump-phase hydrogenator and said gas-phase reactor downstream of said sump-phase hydrogenator.

3. In a sump-phase hydrogenation process having gas-phase hydrogenation, the method of regulating the temperature of carbonaceous input material according to claim 1 wherein said extraction of heat from said sump-phase hydrogenator is extracted from a head cooler in communication with a product from said sump-phase reactor.

4. In a sump-phase hydrogenation process having gas-phase hydrogenation, the method of regulating the temperature of carbonaceous input material according to claim 2 wherein said extraction of heat from said sump-phase hydrogenator is extracted from a head cooler in communication with a product from said sump-phase reactor.

5. In a sump-phase hydrogenation process having gas-phase hydrogenation, the method of regulating the temperature of carbonaceous input material according to claim 1 wherein said extraction of heat from said gas-phase reactor is extracted from a gas exiting therefrom.

6. In a sump-phase hydrogenation process having gas-phase hydrogenation, the method of regulating the temperature of carbonaceous input material according to claim 2 wherein said extraction of heat from said gas-phase reactor is extracted from a gas exiting therefrom.

7. In a sump-phase hydrogenation process having gas-phase hydrogenation, the method of regulating the temperature of carbonaceous input material according to claim 3 wherein said extraction of heat from said gas-phase reactor is extracted from a gas exiting therefrom.

8. In a sump-phase hydrogenation process having gas-phase hydrogenation, the method of regulating the temperature of carbonaceous input material according to claim 1 wherein said heating of said carbonaceous input material with heat from said sump-phase reactor is subsequent to said heating of said carbonaceous input material with heat from said gas-phase reactor.

9. In a sump-phase hydrogenation process having gas-phase hydrogenation, the method of regulating the temperature of carbonaceous input material according to claim 1 including extracting additional heat from said product of said sump-phase reactor subsequent to said heating of said carbonaceous input material thereby;

heating an input material for said gas-phase reactor with said extracted additional heat whereby, as incrustation, of the heat exchanger for transferring heat from said sump-phase reactor product to said carbonaceous input material, increases, additional heat is transferred to said gas-phase reactor input material to compensate for deactivation of a catalyst in said gas-phase reactor.

10. In a sump-phase hydrogenation process having gas-phase hydrogenation, the method of regulating the temperature of carbonaceous input material according to claim 9 wherein said extracting of heat and said additional extracting of heat from said sump-phase reactor is done in head coolers; and said extracted heat from said sump-phase reactor heats said carbonaceous input material to a predetermined temperature and said additionally extracted heat from said sump-phase reactor heats said gas-phase reactor input material to a temperature to start said gas-phase hydrogenation process.

11. In a sump-phase hydrogenation process having gas-phase hydrogenation, the method of regulating the temperature of carbonaceous input material according to claim 1 including setting a predetermined temperature in an intermediate precipitator by transferring heat from a secondary cooler, for cooling said product of said sump-phase reactor, being inputted into said intermediate precipitator.

12. In a sump-phase hydrogenation process having gas-phase hydrogenation, the method of regulating the temperature of carbonaceous input material according to claim 9 including setting a predetermined temperature in an intermediate precipitator by transferring heat from a secondary cooler, for cooling said product of said sump-phase reactor, being inputted into said intermediate precipitator.

13. In a sump-phase hydrogenation process having gas-phase hydrogenation, the method of regulating the temperature of carbonaceous input material according to claim 10 including setting a predetermined temperature in an intermediate precipitator by transferring heat from a secondary cooler, for cooling said product of said sump-phase reactor, being inputted into said intermediate precipitator.

14. In a sump-phase hydrogenation process having gas-phase hydrogenation, the method of regulating the temperature of carbonaceous input material according to claim 11 including setting a temperature in said intermediate precipitator following said sump-phase reactor by first extracting heat from said sump-phase product to heat said carbonaceous input material, and then extracting additional heat therefrom prior to its inputting into said intermediate precipitator.

15. In a sump-phase hydrogenation process having gas-phase hydrogenation, the method of regulating the temperature of carbonaceous input material according to claim 14 wherein said additional extracting of heat from said sump-phase product is used for heating an input product for said gas-phase reactor.

16. In a sump-phase hydrogenation process having gas-phase hydrogenation, the method of regulating the temperature of carbonaceous input material according to claim 15 including extracting yet further heat from said sump-phase product for cooling thereof, and bypassing said yet further heat to an input of said gas-phase reactor.

* * * * *